United States Patent [19]

Bommart

[11] 4,348,959

[45] Sep. 14, 1982

[54] RAIL GAP ADJUSTING DEVICE

[75] Inventor: Patrick Bommart, Rueil-Malmaison, France

[73] Assignee: C. Delachaux, Gennevilliers, France

[21] Appl. No.: 150,579

[22] Filed: May 16, 1980

[30] Foreign Application Priority Data

May 18, 1979 [FR] France ..... 79 12686

[51] Int. Cl.[3] ..... B23K 37/02; E01B 29/20; E01B 33/00

[52] U.S. Cl. ..... 104/15; 29/238; 228/49 R; 254/43; 414/542

[58] Field of Search ..... 104/1 R, 15; 29/238, 29/239, 252; 228/6 R, 49 R; 254/29 A, 106, 228, 246, 43; 414/541, 542

[56] References Cited

U.S. PATENT DOCUMENTS

| | | | |
|---|---|---|---|
| 551,649 | 12/1895 | Raymond | 104/15 |
| 3,291,261 | 12/1966 | Robb | 414/541 X |
| 3,504,810 | 4/1970 | Walda | 414/541 |
| 3,726,232 | 4/1973 | Bryan, Jr. | 104/15 |
| 4,176,777 | 12/1979 | Bommart | 228/49 R X |
| 4,270,036 | 5/1981 | Zollinger | 228/49 R X |

*Primary Examiner*—Joseph F. Peters, Jr.
*Assistant Examiner*—Howard Beltran
*Attorney, Agent, or Firm*—Parmelee, Miller, Welsh & Kratz

[57] ABSTRACT

A device for adjusting the butt-ends of two rails to be connected has a fixed frame for enclosing one of the two rails and two integral bars, parallel to the rails, and extending from the fixed frame toward the other rail. Two movable frames are slidable over a limited portion of the parallel bars in the vicinity of the other rail and can be selectively secured to the other rail so that only one of these two frames is slidably movable. Jacks are provided to effect relative movement between the two movable frames. Actuation of the jacks effects movement of the two movable frames relative to each other and, depending upon which of these frames is secured to the parallel bars, the gap between the two butt-ends will be either increased or decreased.

6 Claims, 4 Drawing Figures

RAIL GAP ADJUSTING DEVICE

The present invention relates to a device for adjusting the distance between two butt-ends of rails to be connected.

In order to connect two butt-ends of rails, such as the butt-ends of railway rails, it is necessary to adjust the gap between the two butt-ends in order to make it possible to carry out subsequently the connecting operation, which may be carried out by welding or by fitting fish-plates.

This adjusting operation may consist either of reducing or increasing the gap between the two butt-ends depending, for example, on the external temperature conditions which may cause an expansion or contraction of the rails.

Devices for adjusting the gap already exist, which comprise two frames respectively able to enclose the two rails, whereof the gap between their butt ends is to be adjusted, and jacks pivotally connected to the two frames for causing the two frames to move towards or away from each other and consequently effecting a reduction or increase in the gap.

The main drawback of these known devices is that they require dismantling in order to enable them to be suitable for an operation for reducing the gap instead of an operation for increasing the gap.

Another drawback of these devices is that they do not always have the necessary power for effecting adjusting apparatus under the most severe conditions.

The main object of the present invention is to provide a device for adjusting the distance between two butt-ends of rails to be connected, which can be adapted, without dismantling, both to an adjusting operation for increasing the gap as well as to an adjusting operation for reducing the gap.

Another object of the invention is to provide an adjusting device which is able to develop the power necessary for adjustment operations under the most severe conditions.

Another object of the invention is to provide a carriage which is able to move along a track and which is equipped with at least one and preferably two handling apparatus each able to move an adjusting device according to the invention in order to make it possible to carry out simultaneously two operations for adjusting the gap size on two lines of rails of a track.

According to the present invention there is provided a device for adjusting the distance between two butt-ends of rails to be connected. The device comprises a fixed frame for enclosing one of the two rails, two parallel bars, wherein one end is integral with the fixed frame, two movable frames and slidable over a limited distance on the parallel bars in the region of their other end and serving to enclose the other rail. Jacks are provided for effecting relative movement of the movable frames on the parallel bars, and wedges for immobilising one of the movable frames on the parallel bars facilitates sliding of the other movable frame on the parallel bars when the jacks are actuated. The sliding movable frame and the fixed frame are secured on their respective rails in order to reduce or increase the gap between two butt-ends according to whether the sliding movable frame is the one closer to or further from the fixed frame.

Preferably, the immobilising member is constituted by two cross-pieces or U-shaped section for covering one of the two parallel bars, either between the movable frame further from the fixed frame and an end stop of the bar, or between the movable frame closer to the fixed frame and an intermediate stop of the bar.

In a preferred embodiment of the invention, the fixed frame comprises for the passage of the rail, a tunnel flaring out at its two ends in order to make it possible to locate two clamping wedges between the two sides of the web of the rail to be clamped and the end of the tunnel which is closer or further to or from the movable frames, according to whether it is a question of reducing or respectively increasing the gap between the two butt-ends of the rails.

In this preferred embodiment, each movable frame comprises a tunnel for the passage of a rail, which is flared towards its end opposite the end closer to the other movable frame in order to make it possible to locate two clamping wedges between the two sides of the web of the rail to be clamped and the tunnel of the sliding movable unit.

An embodiment of the invention will now be described, by way of example, with reference to the accompanying drawings, in which.

Figure 1:
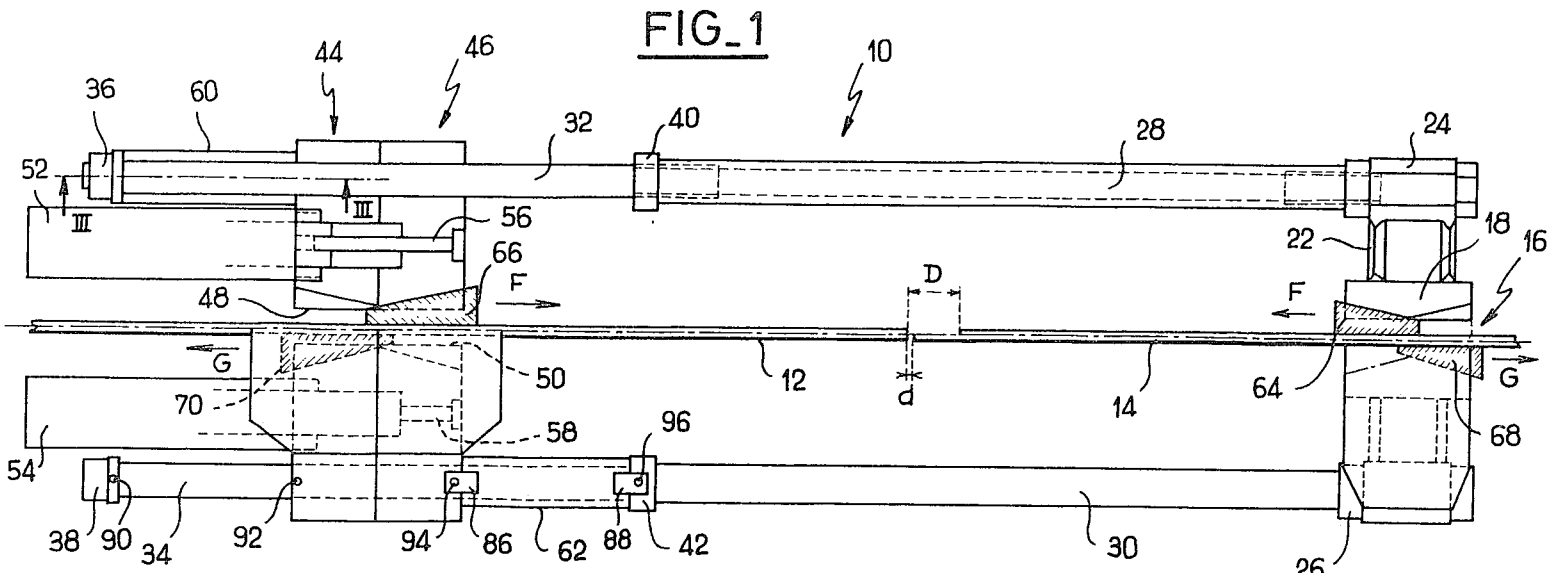
FIG. 1 is a part sectional plan view of an adjusting device according to the invention applied to the adjustment of the gap between two butt-ends of rails with the upper half of the device illustrating the configuration for reducing the gap and the lower half of the device illustrating the configuration for increasing the gap.

FIG. 1 shows an adjusting device 10 according to the invention fitted on a left-hand rail 12 and a right-hand rail 14, of which the gap between the butt-ends is to be adjusted before carrying out the connecting operation. The part of FIG. 1 located above the two rails 12 and 14 shows half of the device 10 carrying out an operation for reducing the gap D between the butt-ends and the part of FIG. 1 located below the rails 12 and 14 shows the other half of the device 10 carrying out an operation for increasing the gap d between the butt-ends.

Figure 2:
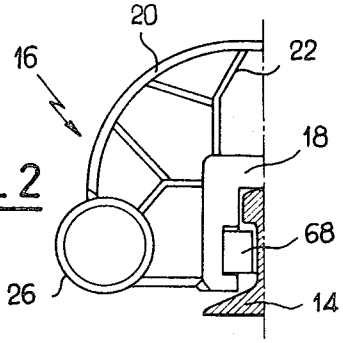
FIG. 2 is an end view of the device of FIG. 1, showing half of the fixed frame.

The device 10 is constituted by a fixed frame 16 which in end view has the general shape of a half-circle (see FIG. 2). The fixed frame 16 comprises a central unit 18 in the form of a U which is open on the under side and defining a tunnel for the passage of the rail 14. This central unit 18 is connected to an outer semi-circular framework 20 by means of reinforcing members 22. Furthermore, the frame 16 comprises two rings 24 and 26 respectively for securing two parallel bars 28 and 30 placed parallel with the rails 12 and 14. The ends of the bars 28 and 30 which are not fastened to the fixed frame 16 serve for the attachment of rods 32 and 34 of circular section. The rods 32 and 34 are arranged as respective extensions of the bars 28 and 30 and are parallel to one another. The rods 32 and 34 constitute sliding bars, whereof the sliding distance is limited by end stops 36 and 38 and by intermediate stops 40 and 42.

The device also comprises two movable frames 44 and 46 slidable on the rods 32 and 34 between the stops 36 and 40 and 38 and 42. The movable frames 44 and 46 are identical and have the general shape of a half-circle similar to the general shape of the fixed frame 16. The movable frames 44 and 46 each respectively define a tunnel 48 forming a passageway and a tunnel 50 forming a passageway for the rail 12.

The frames 44 and 46 may be moved relative to each other by means of two double-acting hydraulic jacks 52 and 54, the cylinders of which are fixed to the movable frame 44 and whereof the respective rods 56 and 58 pass through the frames 44 and 46 and are fastened to the frame 46. The jacks 52 and 54 are disposed parallel to the rods 32 and 34 and consequently to the parallel bars 28 and 30 in order to make it possible to ensure the relative displacement of the frames 44 and 46 by sliding on the rods 32 and 34.

The device 10 also comprises members for immobilising one of the movable frames 44 and 46 on the rods 32 and 34 so to facilitate the sliding of the other movable frame under the action of the jacks 52 and 54.

These immobilisation means are constituted by two cross-pieces 60 and 62 each having a section of U shape for covering the two rods 32 and 34 respectively. The cross-pieces 60 and 62 are placed either between the frame 44, which is furthest from the fixed frame 16 and the end stops 36 and 38 (see the upper part of FIG. 1), or between the frame 46, which is closest to the fixed frame 16 and the intermediate stops 40 and 42 (see lower part of FIG. 1).

In order to adjust the gap between the two buttends of rails to be connected, it is sufficient to surround the rail 12 with the movable frame which will ultimately be moved along the rods 32 and 34 and to enclose the rail 14 with the fixed frame 16.

To this end, the central unit 18 of the fixed frame 16 defines a tunnel for the passage of the rail, which flares out towards its two ends in order to make it possible to position two clamping wedges between the two sides of the web of the rail 14 and the end of the tunnel which is closest to or furthest from the movable frames 44 and 46 according to whether one wishes to reduce or respectively increase the gap between the two butt-ends.

Similarly, the tunnels 48 and 50 of the movable frames 44 and 46 flare out towards their end remote from the end closest to the other movable frame in order to make it possible to locate two clamping wedges between the two sides of the web of the rail 12 to be clamped and the tunnel of the sliding movable unit.

In the case where it is a question of reducing the gap D (see upper part of FIG. 1), two clamping wedges such as 64 are placed between the two sides of the web of the rail 14 and the tunnel of the frame 18, towards the end of the tunnel which is closest to the movable frames 44 and 46 and, similarly, two clamping wedges such as 66 are placed between the two sides of the web of the rail 12 and the tunnel 50 of the movable frame 46.

After having placed the cross-pieces 60 and 62 between the stops 36 and 38 and the movable frame 44, the jacks 52 and 54 are then actuated in order to bring about the movement of the movable frame 46 in the direction of the fixed frame 16. The movement causes locking of the wedges 66 and 64 between the rails 12 and 14 and the frames 46 and 16 and consequently moves the butt-ends of the rails 12 and 14 towards each other in the direction of arrows F.

When it is a question of increasing the gap d (see the lower part of FIG. 1), two clamping wedges 68 are placed between the two sides of the web of the rail 14 and the tunnel of the fixed frame 16 towards the end of the tunnel which is furthest from the movable frames 44 and 46 and two clamping wedges such as 70 are placed between the two sides of the web of the rail 12 and the tunnel 48 of the movable frame 44. In order to increase the gap d, the cross-pieces 60 and 62 are placed between the movable frame 46 and the intermediate stops 40 and 42 and the jacks 52 and 54 are then actuated in order to bring about sliding of the movable frame 44 on the rods 32 and 34. This movement causes locking of the wedges 68 and 70 and consequently the separation of the two butt-ends in the direction of the arrows G. FIG. 2 shows how one of the two wedges 68 is interposed between the U-shaped unit 18 and one of the sides of the web of the rail 14.

Once the adjusting operation has been effected, it is necessary to retract the jacks 52 and 54 in order to return the movable frame which has slid against the movable frame which had been immobilised by the cross-pieces 60 and 62. In order to prevent the immobilised movable frame from sliding on the rods 32 and 34, the invention provides that the two cross-pieces 60 and 62 are each provided with two terminal flanges able to connect each cross-piece to the immobilised movable frame and the intermediate stop or end stop of the corresponding rod.

Figure 3:
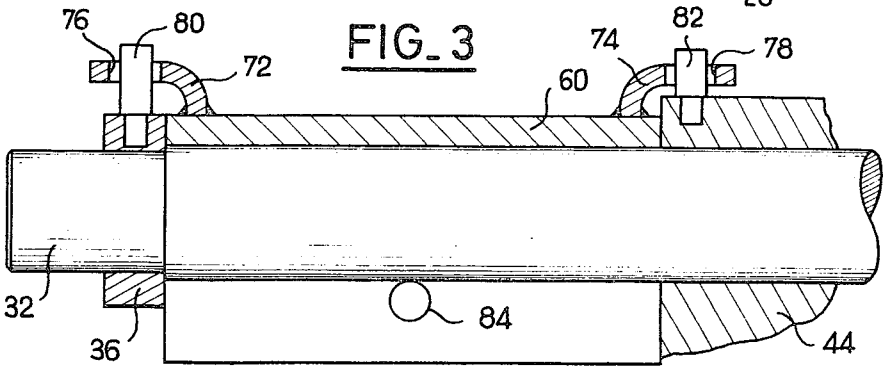
FIG. 3 is a sectional view on line III—III of FIG. 1.

As shown in FIG. 3, the cross-piece 60 is rendered integral with the end stop 36 and the movable frame 44 by means of two bent terminal flanges 72 and 74 which are welded to the cross-piece and provided with respective passageways 76 and 78. The terminal flanges 72 and 74, by means of the passageways 76 and 78, cooperate with retaining lugs 80 and 82 which are integral with the stop 36 and the frame 44. The frame 46 and the intermediate stop 40 are provided with similar lugs (not shown) for positioning the cross-piece 60 between the frame 46 and the stop 40.

In order to prevent the cross-piece 60 from becoming separated from the rod 32, the cross-piece 60 is provided with a through hole 84 for fitting a safety cotter pin.

As shown in FIG. 1, the cross-piece 62 is also provided with two terminal flanges 86 and 88 able to cooperate with lugs 90, 92, 94 and 96 respectively integral with the stop 38, the frame 44, the frame 46 and the stop 42. Naturally, the means for connecting the cross-pieces to the movable frames and the stops may be formed in other ways.

Figure 4:
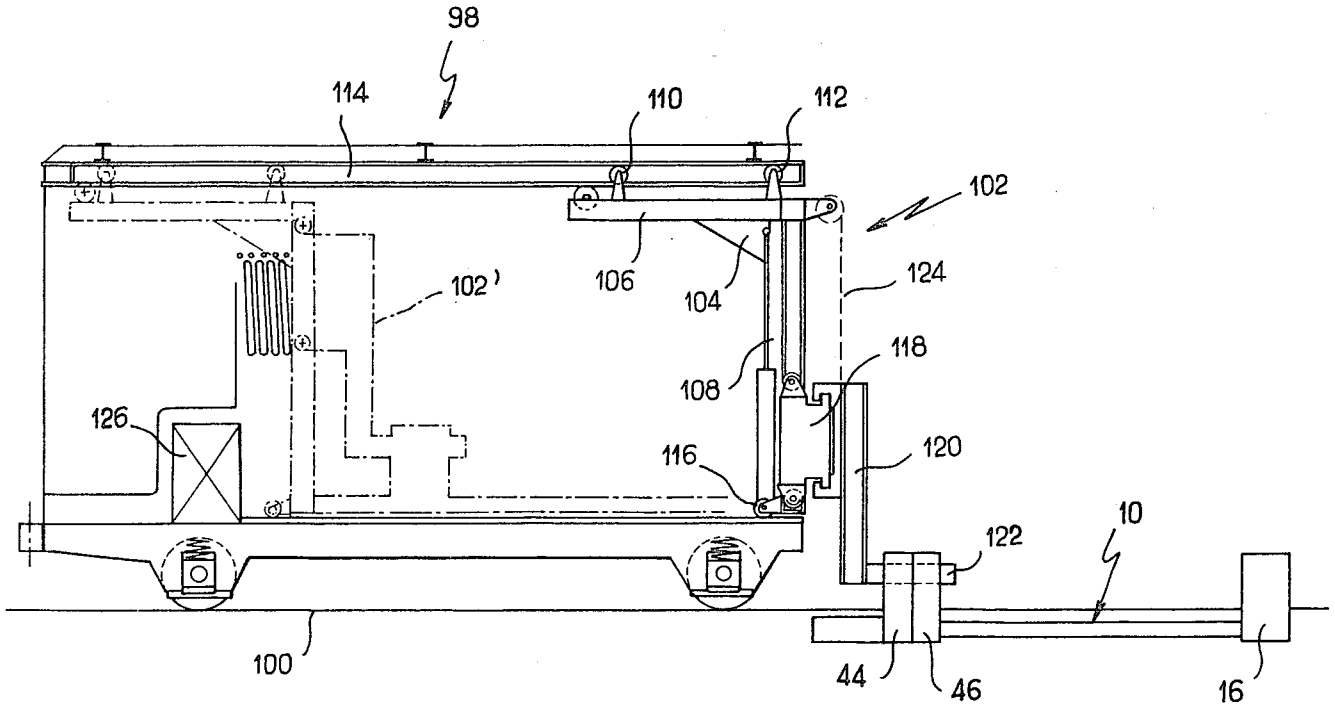
FIG. 4 is an elevation showing a carriage movable along a track and provided with a handling device capable of moving an adjusting device according to the invention.

FIG. 4 shows a self-propelled carriage 98 which is able to travel on a track 100. This carriage is equipped with two identical handling apparatus 102 which are each able to move an adjusting device according to the invention in order to bring the latter to the point at which the connection is to be carried out. Only one of the two apparatus 102 will be described. The handling apparatus 102 is constituted by an L-shaped bracket 104 having a leg 106 and a leg 108 at right angles to each other. The leg 106 is provided with rollers 110 and 112 able to move along a horizontal girder 114 provided in the upper part of the carriage and the leg 108 is provided at its lower end with a roller 116 able to move on the bottom of the carriage 98.

The handling apparatus 102 also comprises a support 118 slidable vertically along the leg 108. This support 118 is provided with horizontal slideways able to support a handling fork 120 provided with two legs 122 able to pass through openings provided in the movable units 44 and 46 of the device 10. Moreover, the fork 120 can be moved vertically under the action of a cable 124 driven by a suitable winch (not shown). Thus, the fork 120 can be moved vertically and/or horizontally in order to deposit the adjusting device 10 at the desired point on the track. The handling apparatus 102 supporting the adjusting device 10 may be moved inside the carriage and occupy the position 102' illustrated in dot dash line.

In view of the fact that the carriage 98 is equipped with two handling devices which can be actuated independently, it thus makes it possible to deposit two adjusting devices at two locations, where one wishes to carry out an adjustment and connection of rails. It is thus possible to carry out two adjusting and connecting operations simultaneously on the two lines of a track, even if the two connecting operations are not exactly in facing relationship on the track.

The carriage 98 is provided with a motor 126 for moving the carriage and the operation of the handling apparatus.

Once the adjusting operation has been completed, the connecting operation is carried out, the device being kept locked in order to keep the gap between the two butt-ends of the rails at the desired value. The connection may be carried out by welding, for example alumino-thermic welding, or by fitting fish-plates.

The adjusting device of the invention may be used for laying or repairing tracks.

Naturally, the invention is not limited to the embodiment particularly described and illustrated.

Thus, instead of using two jacks, one could advantageously use four jacks, for example four identical jacks which are commercially available and each able to develop a force of 30 tons.

Similarly, the device of the invention may be moved to the point at which the connection is to be carried out, by any suitable mechanism.

What is claimed is:

1. An apparatus for adjusting the distance between the butt-ends of a first and second rail to be connected comprising: a fixed frame for enclosing the first rail and means for securing said fixed frame thereto; two parallel bars integral with said fixed frame and extending therefrom toward the second rail, first and second movable frames, slidably mounted for limited movement along said parallel bars in the region of the second rail, means for selectively securing one of said movable frames relative to said parallel bars and means for selectively securing the other of said movable frames relative to the second rail; and jacks in communication with said first and second movable frames for effecting relative movement therebetween such that said movable frame selectively secured to said parallel bars together with said fixed frame and the first rail onto which said fixed frame is secured, is integrally shiftable relative to the second rail and said other movable frame selectively secured thereto.

2. The apparatus for adjusting the distance between the butt-ends of two rails according to claim 1 wherein the means for selectively securing the movable frames on the parallel bars comprises two cross-pieces of U-shaped section for covering the parallel bars and wherein each of said parallel bars includes an end stop distal the fixed frame and an intermediate stop between said end stop and said fixed frame, said movable members being mounted between said stops, whereby said securing means may be selectively positioned between the movable frame further from the fixed frame and the end stop and between the movable frame closer to the fixed frame and the intermediate stop.

3. The apparatus for adjusting the distance between the butt-ends of two rails according to claim 2 wherein the two cross-pieces include a flange at each end thereof, and the end and intermediate stops include integral flange engaging means through which said cross-pieces are removably secured thereto.

4. The apparatus for adjusting the distance between the butt-ends of two rails according to claim 1 or 2 wherein the fixed frame has a tunnel therethrough for the passage of the rail, said tunnel having a flared portion at both ends thereof and the means for securing said fixed frame to the first rail consist of wedges insertable between the sides of the web of the rail and the flared portion of said tunnel.

5. The appartus for adjusting the distance between the butt-ends of two rails according to claim 4 wherein each of the two movable frames has a tunnel therethrough for the passage of the rail, said tunnel having a flared portion at both ends thereof, and the means for selectively securing the movable frames to the rail consist of wedges insertable between the sides of the web of the rail and the flared portion of the tunnel.

6. An apparatus for adjusting the distance between the butt-ends of a first and second rail to be connected comprising in combination an adjusting apparatus comprising:

a fixed frame for enclosing the first rail and means for securing said fixed frame thereto; two prallel bars integral with said fixed frame and extending therefrom toward the second rail, first and second movable frames, slidably mounted for limited movement along said parallel bars in the region of the second rail, means for selectively securing one of said movable frames relative to said parallel bars and means for selectively securing the other of said movable frames relative to the second rail; and jacks in communication with said first and second movable frames for effecting relative movement therebetween such that said movable frame selectively secured to said parallel bars together with said fixed frame and the first rail onto which said fixed frame is secured, is integrally shiftable relative to the second rail and said other movable frame selectively secured thereto; and a carriage onto which said adjusting apparatus is mounted for the support and transport thereof.

* * * * *